US005526747A

United States Patent [19]

Marmin et al.

[11] Patent Number: 5,526,747

[45] Date of Patent: Jun. 18, 1996

[54] DEVICE FOR REPLACING PRINTING PLATES IN ROTARY PRINTING PRESSES

[75] Inventors: Jean-Claude Marmin, Estrees-Saint-Denis; Jacky Planas, Creil, both of France

[73] Assignee: Heidelberger Druckmaschinen AG, Heidelberg, Germany

[21] Appl. No.: 422,459

[22] Filed: Apr. 17, 1995

[30] Foreign Application Priority Data

Nov. 15, 1994 [FR] France ..... 94 04609

[51] Int. Cl.[6] ..... B41F 21/00

[52] U.S. Cl. ..... 101/477; 101/415.1

[58] Field of Search ..... 101/415.1, 477, 101/383, DIG. 36, 216

[56] References Cited

U.S. PATENT DOCUMENTS

| | | | |
|---|---|---|---|
| 5,111,744 | 5/1992 | Wieland | 101/216 |
| 5,218,907 | 6/1993 | Komori et al. | 101/477 |
| 5,361,699 | 11/1994 | Compera | 101/477 |
| 5,443,006 | 8/1995 | Beisel et al. | 101/477 |

FOREIGN PATENT DOCUMENTS

| | | | |
|---|---|---|---|
| 431715 | 6/1991 | European Pat. Off. . | |
| 432660 | 6/1991 | European Pat. Off. . | |
| 433798 | 6/1991 | European Pat. Off. . | |
| 570702 | 11/1993 | European Pat. Off. . | |
| 0176558 | 7/1989 | Japan | 101/415.1 |
| 0008403 | 1/1994 | Japan | 101/415.1 |

*Primary Examiner*—Christopher A. Bennett
*Attorney, Agent, or Firm*—Kenyon & Kenyon

[57] ABSTRACT

The present invention relates to a device for replacing printing plates in rotary printing presses. The printing presses include plate cylinders with a gap for receiving both ends of a printing plate while the surface of the printing plate is wound around the plate cylinder. The device includes a ramp for receiving a printing plate on the plate cylinder after the plate has been released by the clamping mechanism of the plate cylinder, and a ramp for feeding a new printing plate to the plate cylinder. The invention is characterized by horizontally movable holding elements provided close to the outer cylindrical surface of the plate cylinder. The holding elements hold the front edge of a printing plate to be fed, until pivotable holding devices, grip the front edge of the printing plate to be fed to bring it in contact with the outer cylindrical surface of the plate cylinder.

20 Claims, 10 Drawing Sheets

DEVICE FOR REPLACING PRINTING PLATES IN ROTARY PRINTING PRESSES

BACKGROUND OF THE INVENTION

1. Field of the Invention

The present invention relates to a device for replacing printing plates in rotary printing presses having plate cylinders. The plate cylinders receive both ends of a printing plate in the cylinder gap while the surface of the printing plate is wound around the plate cylinder. The device has a facility for taking a printing plate from the plate cylinder after it has been released by the clamping devices of the plate cylinder and a facility for feeding a new printing plate to the plate cylinder.

2. Description of the Related Art

European Patent Application No. 0 433 798 discloses a method and a device for automatic feeding and/or removing of printing plates. This device is provided with a storage section for receiving a printing plate to be removed from a plate cylinder before a new printing plate is clamped on the plate cylinder. In close vicinity to the plate cylinder receiving the printing plates there are provided transport and pressure rollers in order to ensure exact feeding of the printing plate front edge. However, the newly supplied printing plate as well as the printing plate to be removed from the plate cylinder, for the greater part of their transport path, are moved over resting surfaces, so that scratching of the highly sensitive surfaces of the supplied and removed printing plates can still occur.

European Patent Application No. 0 432 660 also discloses a method and device for automatic replacement of a printing plate. The device for implementing the method includes a number of transport rollers disposed between the storage sections for the printing plates. Between the transport rollers and the surface of the plate cylinder or the wide cylinder gap there are arranged a movable discharge finger and a guide plate. This construction has an elaborate, costly mechanism which also impairs access to the printing units of a rotary printing press.

The European Patent Application No. 0 570 702 shows a device for supplying printing plates to the plate cylinder of printing presses, particularly sheet-fed offset presses. This device includes an angular sheet-metal plate which is operable by a pneumatic cylinder, whereby the plate profile is pressed against brushes. Through the space formed between the sheet-metal plate profile and the brushes, a new printing plate can be fed directly into the clamping bar of a plate cylinder. There is no mention made about the handling of a printing plate to be removed from the plate cylinder before a new printing plate is fed to the plate cylinder in that application. The teachings of this prior art document are concentrated on the simplification of the feed of the printing plate front edge.

European Patent Application No. 0 431 715 a shows further plate-changing device for printing presses. This device relates to sheet-fed rotary printing presses and includes a storage section for a new printing plate to be fed as well as for the printing plate released form the plate cylinder. This device is defined by a cassette which holds multiple printing plates, the cassette being pivotally mounted between the serially-arranged printing units of a sheet-fed rotary press. In the cassette there are multiple L-shaped hooks with which the individual printing plates can be fastened in the cassette, so that considerable mechanical expenditure has to be made for the storage of printing plates in a pivotable cassette.

SUMMARY OF THE INVENTION

In view of prior an mentioned herein above, it is the object of present invention to provide for reliable, low-cost feeding and removal of printing plates to and from a plate cylinder.

According to the present invention, it is the solution to this object that pivotable holding devices which temporarily hold a region of a printing plate to be fed will elastically deform this region in such a way that one end of the printing plate will be in contact with the outer cylindrical surface of the plate cylinder.

The advantage of this inventive idea lies in the fact that the elasticity of thin printing plates is utilized to feed the respective printing plate from edge into the narrow gap in plate cylinders. Then, after the removal of the printing plate from the circumference of the plate cylinder, a reversal of the direction of rotation of the plate cylinder is performed, which is necessary for the feeding of the new printing plate, and the front edge of the new printing plate can dip into the plate cylinder gap. The force required for the printing plate front edge to dip into the plate cylinder gap is generated by the pivotable holding device which can be positioned so as to effect the contact of the printing plate from edge with the plate cylinder surface. The holding device allows a continuous feed of the printing plate while keeping it away from the from part of an infeed ramp, so that damage to the printing plate is avoided. The continuous pressure-loading of the holding device during the feeding movement of the new printing plate is ensured.

According to other characteristic feature of the present invention, the holding devices are disposed on a support plane which is pivotable around a pivot axis, whereby the holding devices rest equally distributed on one region of the printing plate. The support plane is movable through controllable actuating units, for example, through actuating cylinders loaded with a pressure medium. The pivotable support plane on which the holding devices are arranged is situated above the infeed ramp. The holding devices, for example, are designed for application of vacuum, since vacuum can be easily and uniformly supplied, a there already exists a pneumatic system at the printing units.

The device for feeding a printing plate as well as the device for receiving the printing plate to be removed are designed as ramps. The conveying planes for the printing plates on these inclined ramps are formed by the circumferential surface of rotatably mounted rotary bodies. It has been proven to be very advantageous that the printing plate to be fed can be brought onto the infeed ramp in an essentially upright position.

According to a further characteristic feature of the present invention, horizontally movable holding devices are arranged below the infeed ramp, adjacent to the outer cylindrical surface of the plate cylinder. These movable holding elements temporarily hold the front edge of a printing plate to be fed, i.e., until a region of the printing plate to be fed is gripped by the holding devices which are disposed on a pivotable support plane. The horizontally movable holding devices are provided with actuating units which effect the horizontal movement.

Furthermore, below the removal ramp there is provided a holding device which grips the printing plate to be removed and moves it to a final removal position. There, the printing plate can be very easily be removed by an operator. In order to secure this final removal position of the printing plates, there is provided at least one holding bracket below the removal ramp.

BRIEF DESCRIPTION OF THE DRAWINGS

These and other characteristic features of the invention will be explained in detail in the following description which will be best understood when read in connection with accompanying drawings, in which.

DETAILED DESCRIPTION OF THE INVENTION

Figure 1:
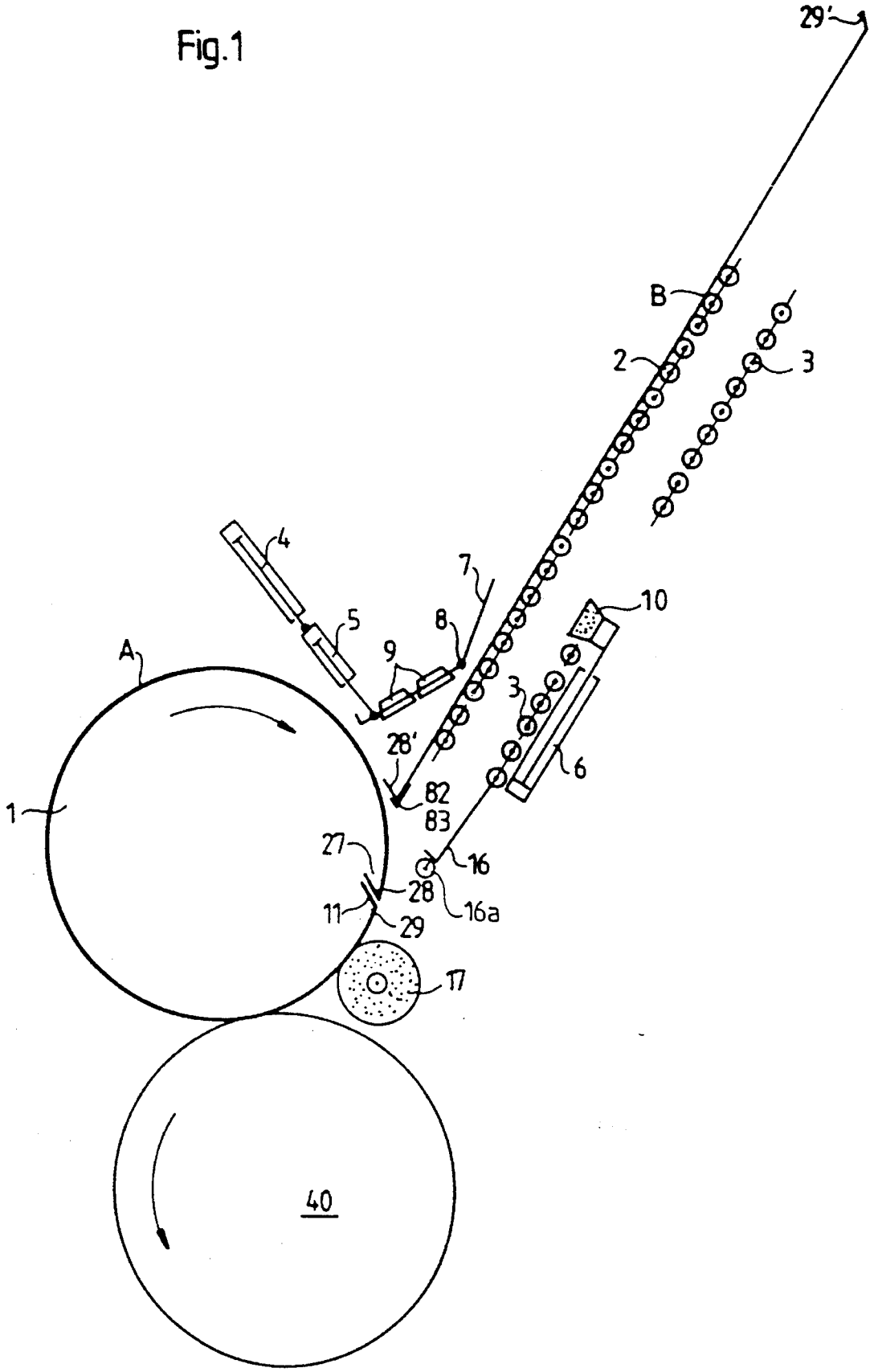
FIG. 1 shows a side view of a pair of cylinders of a printing unit, wherein the plate cylinder is associated with an infeed ramp as well as with a removal ramp having pneumatic holding elements.

A plate cylinder 1 is associated with an infeed ramp 2 and with a removal ramp 3. The infeed ramp 2 as well as the removal ramp 3 are formed by a plurality of loosely rotatable rollers disposed in one plane, so that the printing plates A and B deposited thereon can be conveyed almost without friction. Above the infeed ramp 2 there is shown a pair of actuating cylinders 4, 5 which pivot holding device 9 around an axis 8. For the drive of these actuating cylinders 4, 5 there can be provided a driving mechanism of compact design which may be controlled electromagnetically, electrically, hydraulically or even pneumatically, in order to feed the printing plate into the cylinder gap 11 exactly at the moment when the cylinder gap 11 is positioned opposite the angled end of the printing plate front edge. Also, a support 7 is mounted so as to be pivotable around the axis 8. On the infeed ramp 2 there is placed a new printing plate B to be fed, having a front edge 28' and a rear edge 29', as shown in FIG. 1. Below the removal ramp 3 there is arranged an actuating cylinder 6 which moves a holding device 10 into various positions within the removal ramp 3. In the front region of the removal ramp 3 there is arranged a holding bracket 16 on which a printing plate A to be removed from the plate cylinder 1 can be deposited.

The plate cylinder 1 shown in FIG. 1 carries a printing plate A to be exchanged, rear edge 29 of which is clamped in the plate cylinder gap 11. Furthermore, a pressure roll 17 as well as a transfer cylinder 40, arranged therebelow and not shown in detail, cooperate with the outer cylindrical surface of the plate cylinder 1. The plate cylinder 1 and the transfer cylinder 40 cooperating with one another form, for example, an upper printing unit in a rotary printing press, which is arranged above a material web to be processed.

It is to be noted that schematically illustrated holding elements 82 and 83, which are movable perpendicularly to the drawing plane as described below, limit the lower end of the infeed ramp 2.

Figure 2:
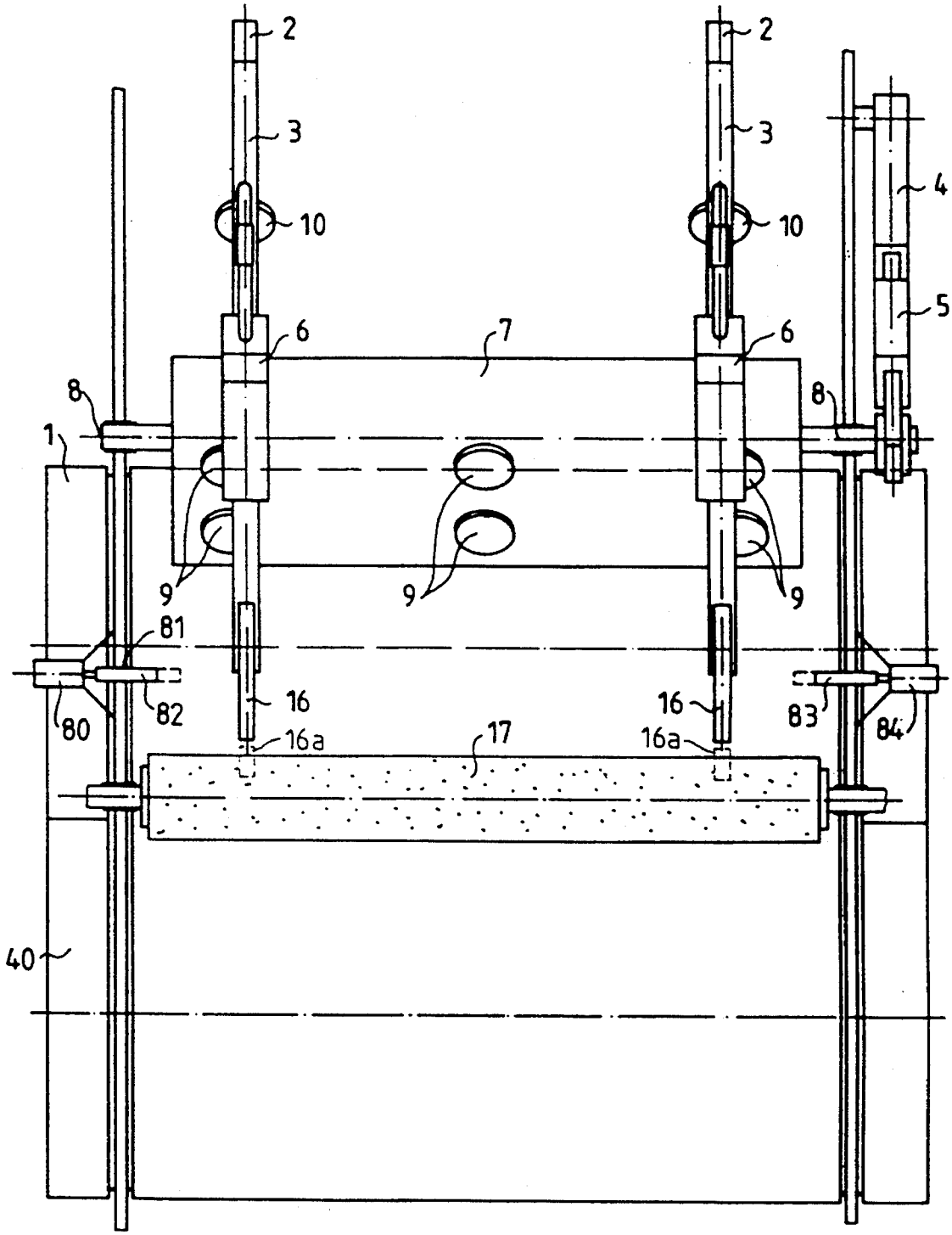
FIG. 2 shows a front view of the printing plate feed and removal device according to the invention.

FIG. 2 shows a front view of the device of the present invention. The plate cylinder 1 and transfer cylinder 40 are rotatably mounted in the schematically shown side walls of a rotary printing press. Also, a pressure roller 17 is associated with the plate cylinder 1.

A pair of actuating cylinders 4, 5, which are mounted in one of the side walls, pivot a support 7 around an axis 8, with holding devices 9 being disposed on the support 7. Furthermore, the holding elements 82 and 83 are mounted in the schematically illustrated side walls. The holding element 82 has a lateral stop 81. As indicated in FIG. 2, the holding element 82 and 83 are horizontally movable through respective adjustment units 80 and 84. These adjustment units 80 and 84 can be electromagnetically operated units or pneumatic cylinders connectable to the pressurized air supply of the rotary printing press. When the holding elements 82, 83 are in their extended position, as indicated by a broken line, the front end of the end of the printing plate B to be clamped on the plate cylinder 1 rests on the plate cylinder 1 in correct lateral alignment through the stop 81.

As also shown in FIG. 2, actuating cylinders 6 for actuation of the holding devices 10 are arranged below the removal ramp 3 and have rod-like extensions on which the holding devices 10 are arranged. As mentioned hereinbefore, the printing plate A to be removed can be completely removed from the printing unit by these holding devices 10 and be disposed on the holding bracket 16 forming the lower end of the removal ramp 3. The infeed ramp 2 is schematically indicated above the removal ramp 3. The support 7 bearing the holding devices 9 is pivotable about the axis 8. The holding devices 9 are connected with one another through a central vacuum supply system ensuring simultaneous and uniform loading of said holding devices 9 during the infeed of a new printing plate B. In printing presses having a plate cylinder which receives multiple printing plates side by side, multiple printing plate replacement devices according to the invention can be arranged side by side.

Figure 3:
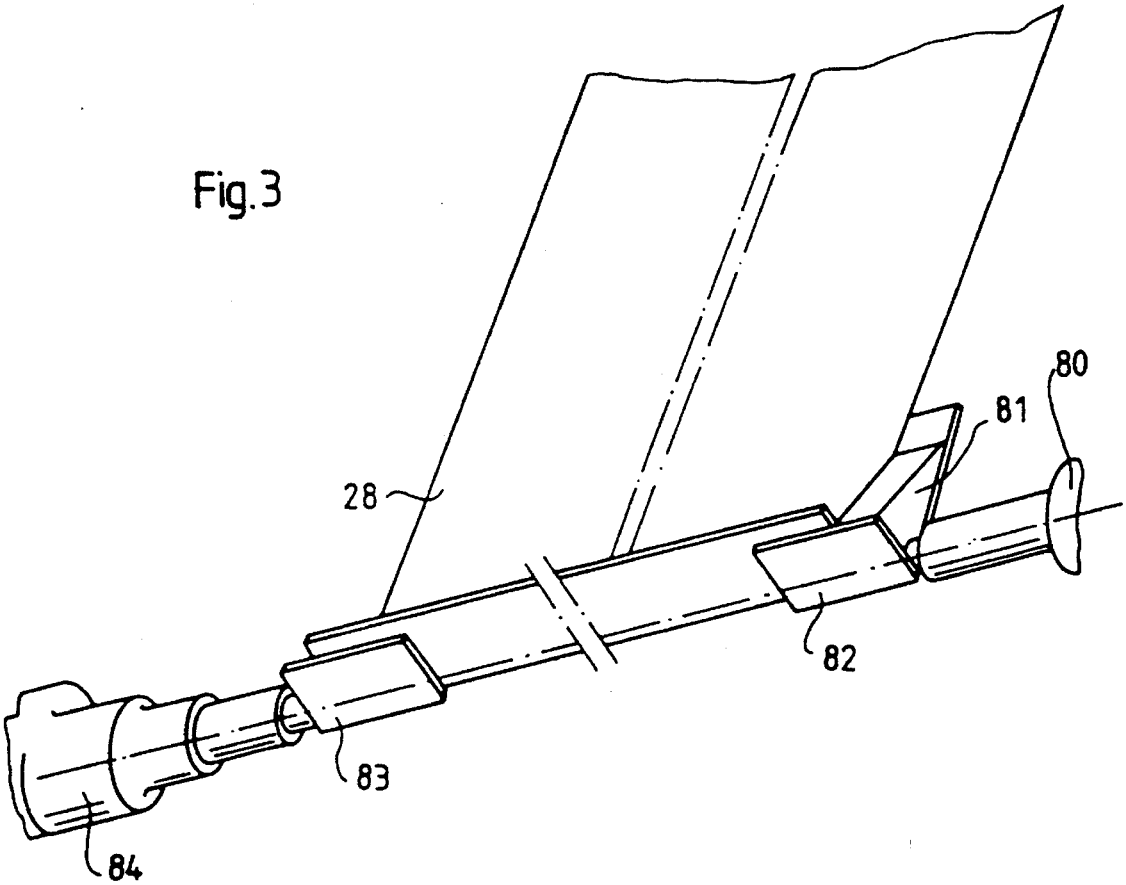
FIG. 3 shows an enlarged illustration of the horizontally movable holding elements.

FIG. 3 is an enlarged illustration of the holding device for the new printing plate B to be mounted. The holding elements 82, 83 are in the shape of angular pieces and can be moved by a cylinder adjustment unit 84. One holding element, in this case the holding element 82, has lateral stop 81, in order to laterally align the printing plate B to be newly supplied correctly before its infeed into the printing unit.

Figure 4:
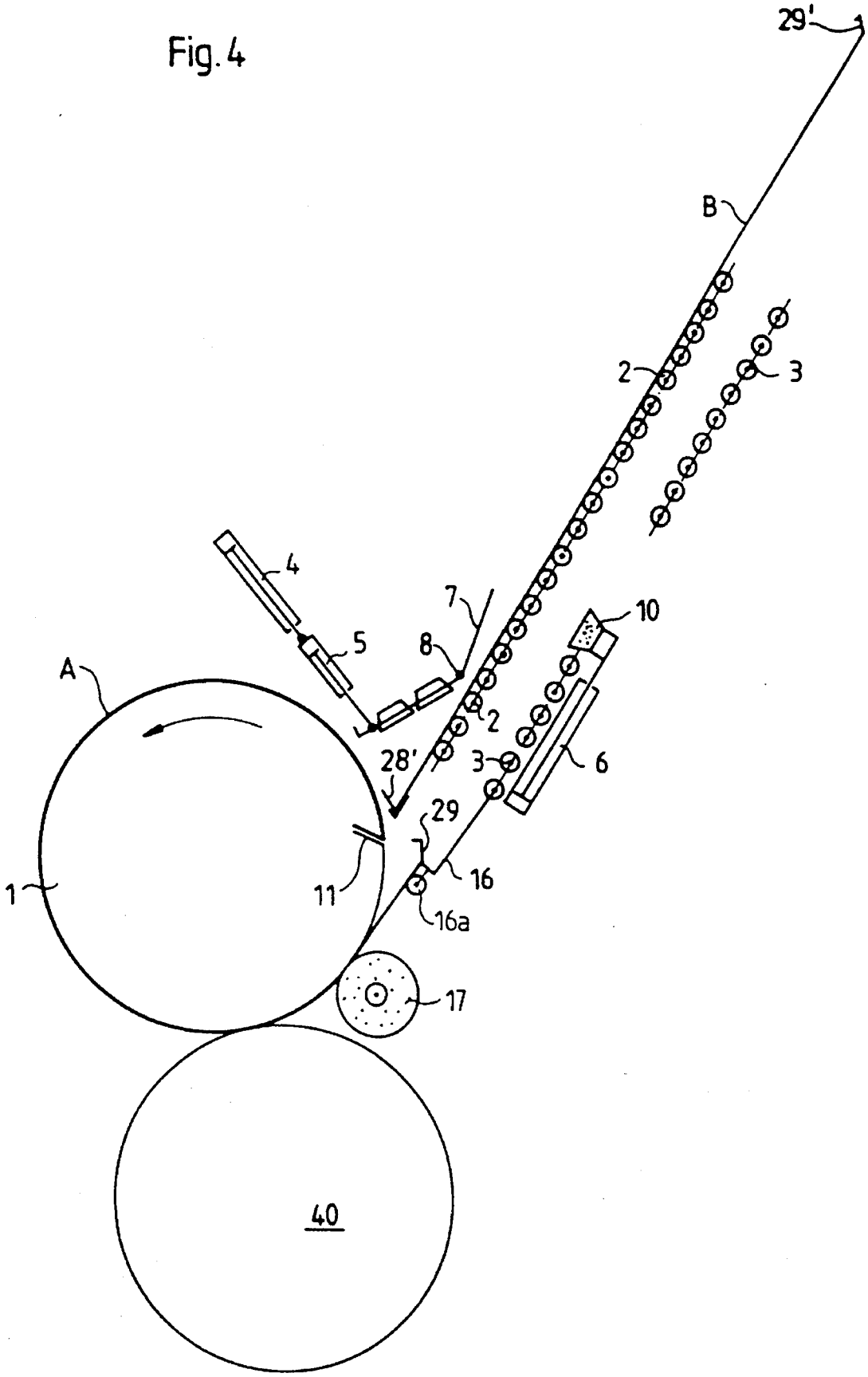
FIG. 4 illustrates the start of the removal of a printing plate A from the plate cylinder.

FIG. 4 shows how the printing plate A to be replaced moves from the plate cylinder 1 and enters the removal ramp 3. The rear edge 29 rests on roller 17 in front of the holding bracket 16. Continuing rotation of the plate cylinder 1 in the direction of the arrow causes the printing plate A to move from the plate cylinder 1 and to proceed onto the rollers defining the removal ramp 3. The removal of the printing plate A from the outer circumference of the plate cylinder 1 is supported by the pressure roller 17. The removal motion of the printing plate A to be replaced is performed exclusively by the rotation of the plate cylinder 1. There is no need for further support for transporting the printing plate A to be replaced.

As also shown in FIG. 4, the new printing plate B on the infeed ramp 2 rests on the holding elements 82 and 83. The pair of actuating cylinders 4, 5 hold the holding devices 9 in a disengaged position.

Figure 5:
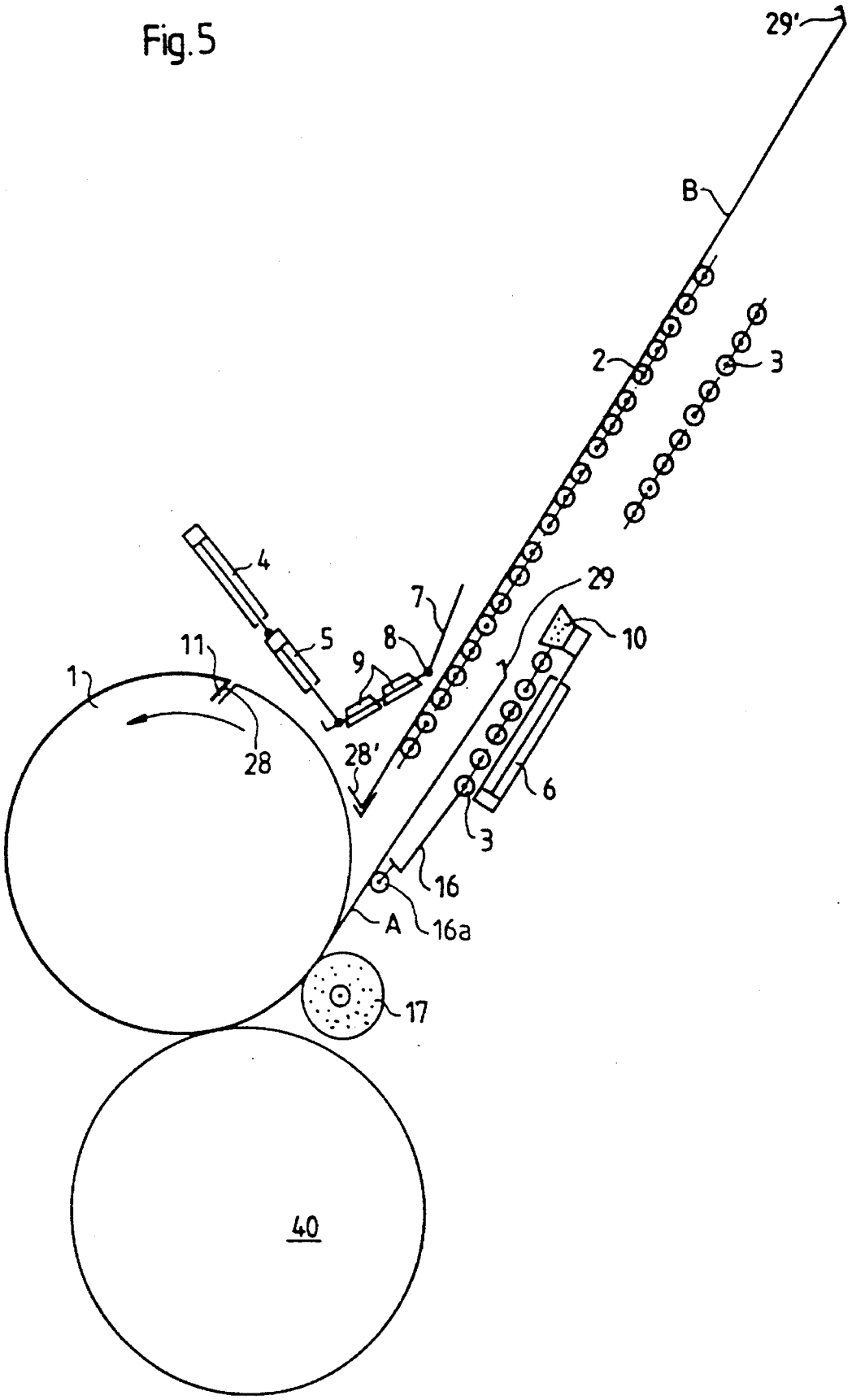
FIG. 5 illustrates an advanced state of the removal of printing plate A from the plate cylinder.

In FIG. 5 the printing plate A moving from the plate cylinder 1 is shown transported further onto the removal ramp 3 but is not gripped yet by the holding device 10 actuated through an actuating cylinder 6. As already explained with respect to FIG. 4, the printing plate A, with its printing surface, rests on a roller 16*a* while moving away from he plate cylinder 1, so as to be protected against scratches which could be caused by the holding bracket 16.

The actuating mechanisms for the new printing plate B, which is located on the infeed ramp 2, are still at rest in FIG. 5.

Figure 6:
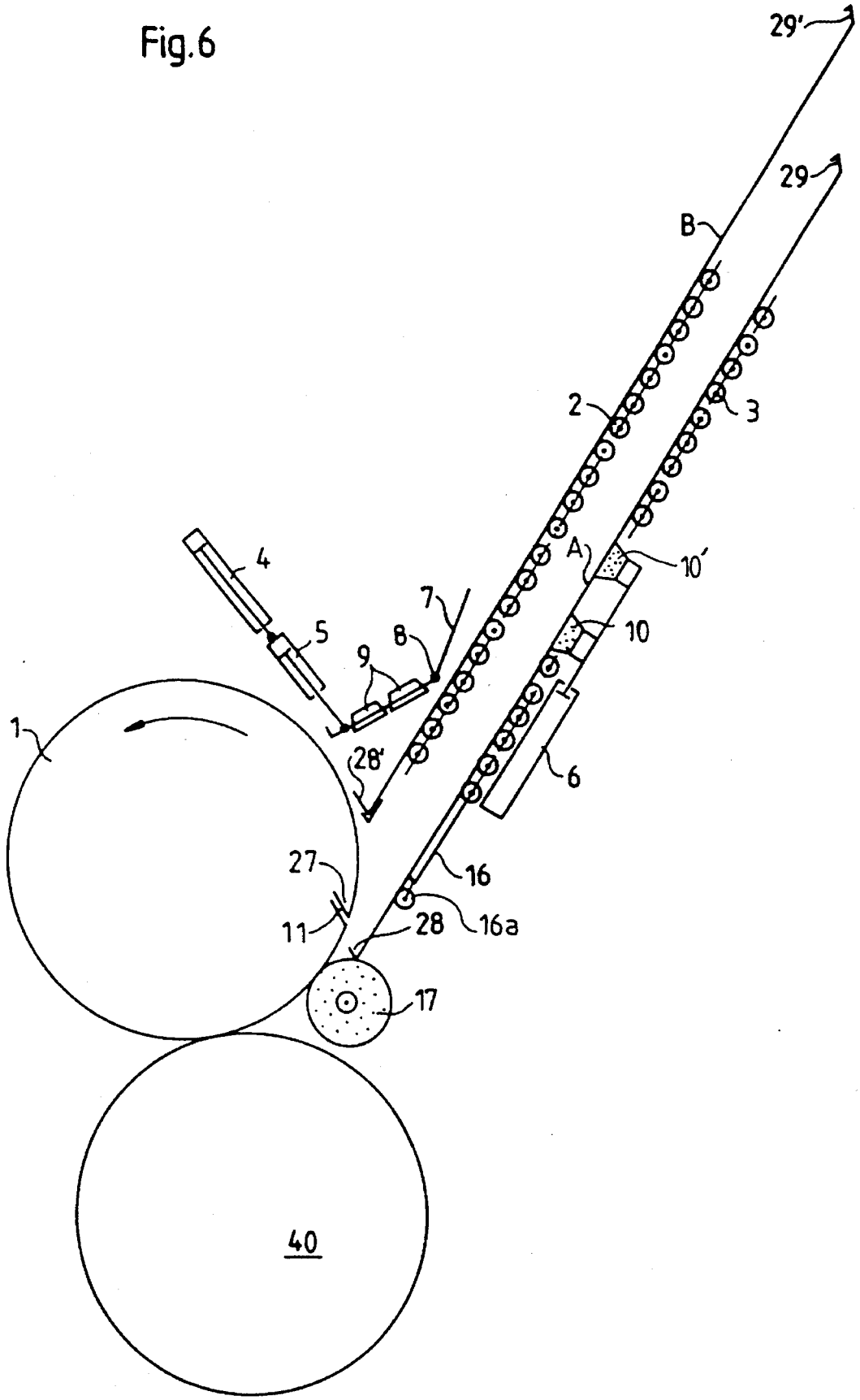
FIG. 6 illustrates the gripping of the printing plate A by holding devices arranged below the removal ramp.

In the state shown in FIG. 6 the printing plate A to be removed has left the outer cylindrical surface of the plate cylinder 1. The front edge 28 rests on the pressure roller 17. The printing plate A is further protected against scratching by the roller 16*a* arranged in front of the holding bracket 16. The rear edge 29 of the printing plate A to be removed has already left the rollers defining the removal ramp 3. In this position the printing side of the printing plate A to be removed is gripped by a pneumatic holding device 10, since the printing plate A is not transported any further against gravity on the removal ramp 3 through rotation of the plate cylinder, because there is no contact any more between the printing plate A and plate cylinder 1.

Figure 7:
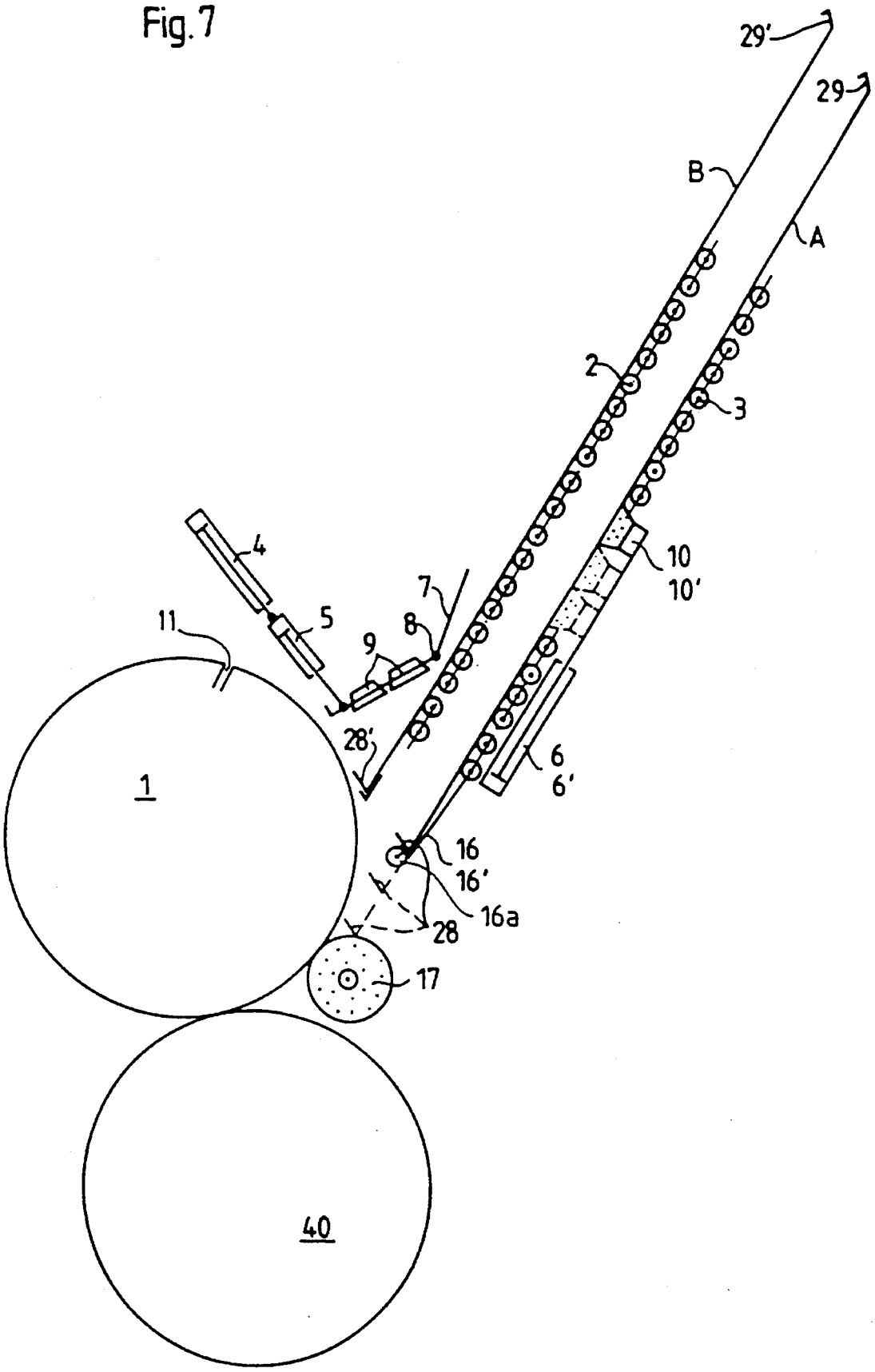
FIG. 7 illustrates the deposit of the removed printing plate A in the holding bracket on the removal ramp.

As illustrated in FIG. 7, the printing plate A to be removed is moved on the removal ramp 3 by the holding device 10 which moves itself into a deflected position 10', until the front edge 28 of the printing plate A to be removed snaps into the holding bracket 16 and is supported thereon. In this position the printing plate A to be removed is secured against damage and against falling off, and the vacuum in the holding device 10 can be switched off and printing plate A may be removed by the operator. In this state, the devices moving the new printing plate B are still at rest.

Figure 8:
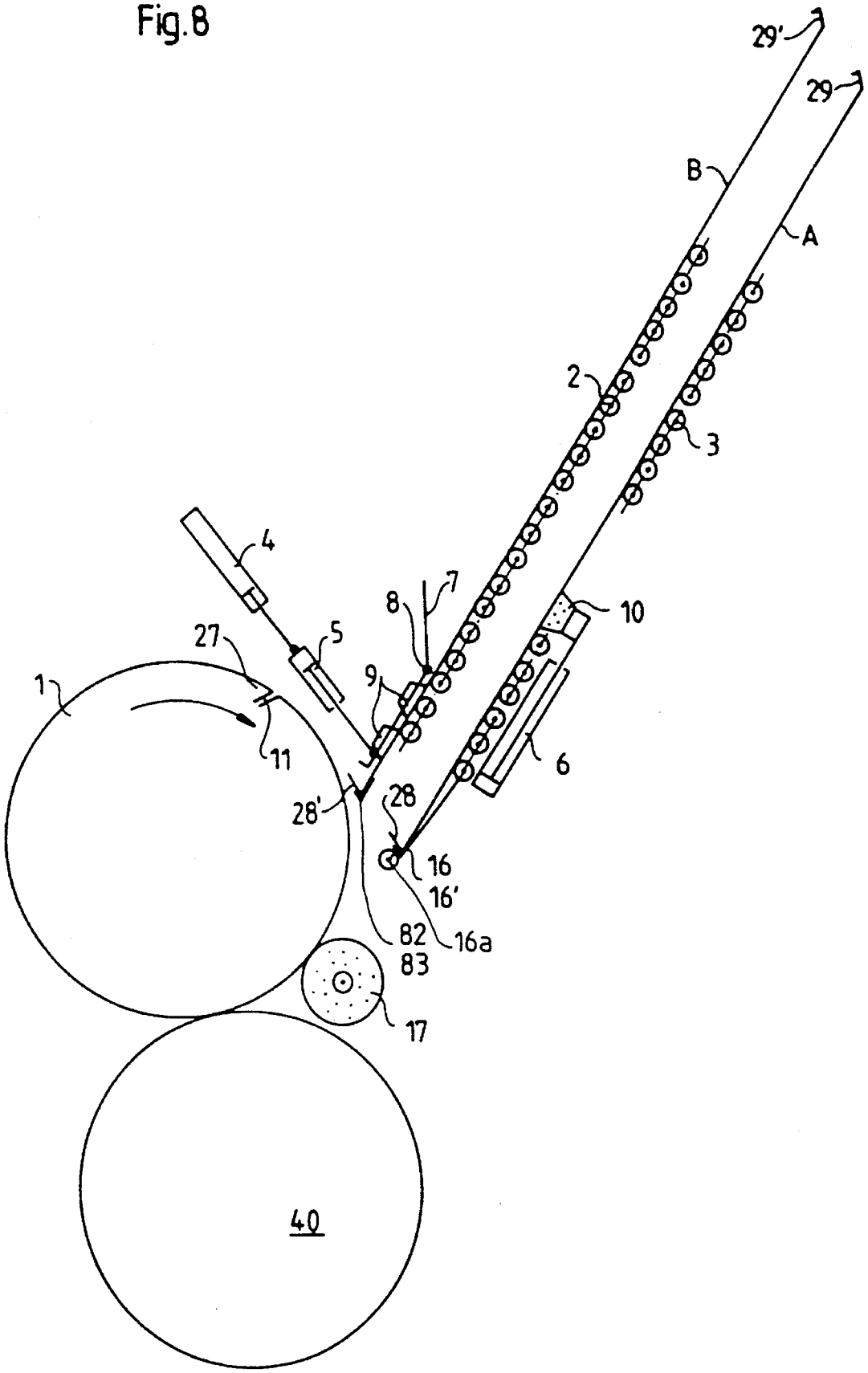
FIG. 8 illustrates the gripping of the front region of a new printing plate B to be fed by pneumatic holding devices.
Figure 9:
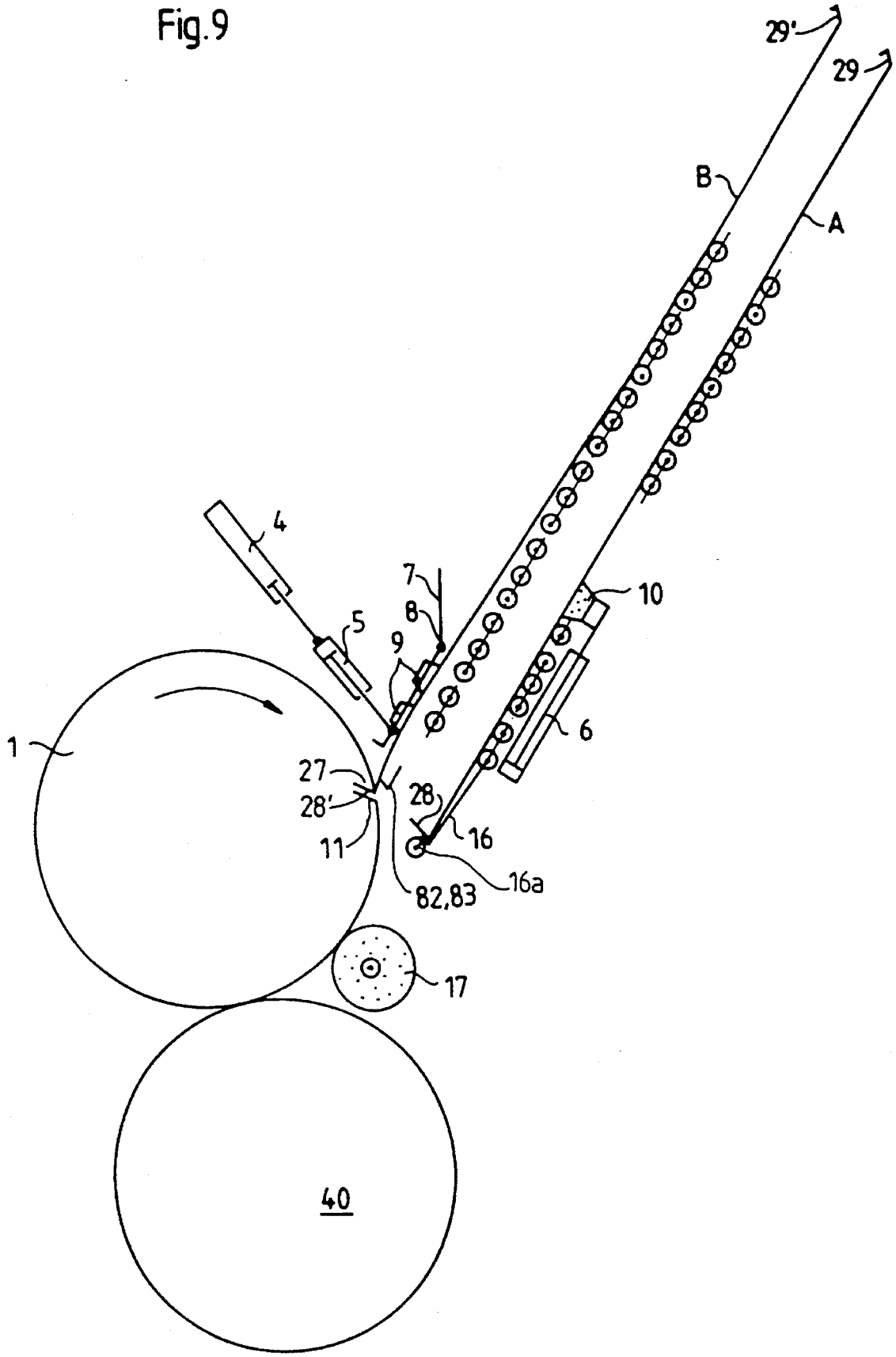
FIG. 9 illustrates the clamping in the plate cylinder gap of the front edge of the printing plate B to be fed.

In the state shown in FIG. 8, the pneumatic holding devices 9, which are disposed on the support 7 pivoting around the axis 8, are brought in contact with the back side of the new printing plate B through the pair of actuating cylinders 4, 5. The pivotal motion of the support 7 with holding devices 9 around the axis 8 has the effect that the support 7 takes an upright position, thereby defining an infeed funnel. Next, the plate cylinder 1 is rotated at creeping speed (e.g., 1–2 revolutions per minute) in the direction of the arrow and opposite to the direction of rotation illustrated in all previous figures. The holding elements 82 and 83 are retracted by their adjustment units and release the front edge 2 of the new printing plate B. The printing plate B is solely held by the holding devices 9 on the support 7 pivoting around the axis 8. Through the suction produced by the holding devices 9 the front region of new printing plate B comes into contact with the outer cylindrical surface of the plate cylinder 1. As a result front edge 28' of the new printing plate B is clamped in the gap 11 of the plate cylinder 1 and the infeed of the new printing plate B has begun (see FIG. 9). As the holding devices 9 on the support 7 pivoting around the axis 8 are continuously supplied with a vacuum, the new printing plate B can be held in a position which facilitates this infeed movement. The respective region of the new printing plate B not yet positioned on the plate cylinder is held solely by the holding mechanisms for the actuating cylinders 4, 5 to move the holding devices 9, thereby permitting feeding the printing plate front edge 28 into the plate cylinder gap 11 at the moment when the cylinder gap 11 is situated below the printing plate front edge 28'.

Figure 10:
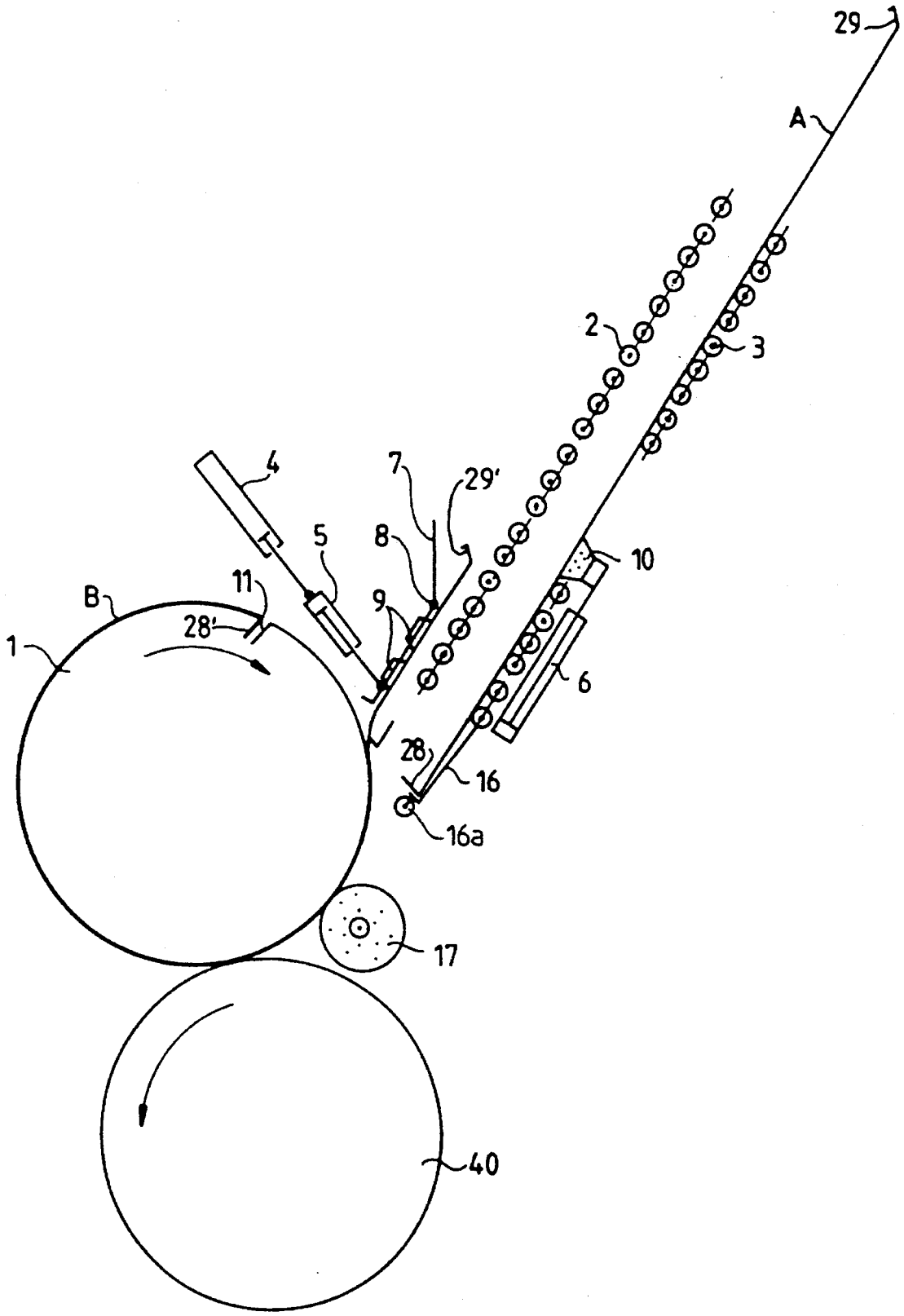
FIG. 10 illustrates the end phases of the infeed procedure of the new printing plate B.

In the state illustrated in FIG. 10 the feed of the new printing plate B onto the outer surface of the plate cylinder 1 is almost completed. The front edge 28' of the new printing plate B has been fed into the gap 11 while the rear edge 29' of the printing plate B still is held by the holding devices 9 above the infeed ramp 2. An imperfect seal is created between the holding devices 9 and the new printing plate B, such that the lateral force on the printing plate B caused by wrapping the printing plate B around the plate cylinder 1 is greater than the lateral force on the printing plate B caused by the holding devices 9, while the vertical force on the printing plate B continues to hold the printing plate B against the holding devices 9. The imperfect seal is created by either having a rough contact surface on the holding devices 9, or a hole of small diameter in the holding devices 9. By switching off the vacuum at this time, the rear edge 29' of the new printing plate B is released, and with the support of the pressure roller 17 the new printing plate B is pressed onto the outer cylindrical surface of the plate cylinder 1, and after the pressure roller 17 has passed, the rear edge 29' of the printing plate B dips into the gap 11 of the plate cylinder 1.

We claim:

1. An apparatus for replacing printing plates in a rotary printing press, said rotary printing press comprising a plate cylinder with a circumference and a gap for receiving both ends of a printing plate while a surface of the printing plate is wound around said plate cylinder, said gap comprising a clamping device, said apparatus comprising:

an element for receiving a printing plate from said plate cylinder, after said printing plate has been released by said clamping device;

an element for feeding a new printing plate to said plate cylinder; and a pivotable holding device which temporarily holds a region of said new printing plate and pivots said new printing plate toward said plate cylinder such that a front edge of said new printing plate is brought into contact with said circumference of said plate cylinder, said pivotable holding element elastically deforming said front edge by forcing said front edge of said new printing plate against said circumference.

2. The apparatus of claim 1, wherein:

said holding device is disposed on a support which is pivotable around a pivot axis.

3. The apparatus of claim 2, wherein:

said support is movable by remotely controlled actuating units.

4. The apparatus of claim 1, wherein:

said holding device is supplied with a vacuum.

5. The apparatus of claim 1, wherein:

said element for feeding a new printing plate is an infeed ramp.

6. The apparatus of claim 1, wherein:

said element for receiving a printing plate is a removal ramp.

7. The apparatus of claim 1, wherein:

said element for feeding a new printing plate and said element for receiving a printing plate comprise rotatably mounted rotary bodies.

8. The apparatus of claim 5, wherein:

said infeed ramp is essentially upright.

9. The apparatus of claim 5, further comprising:

a horizontally movable holding element below said infeed ramp.

10. The apparatus of claim 9, wherein:

said horizontally movable holding elements temporarily hold a front edge of said new printing plate.

11. The apparatus of claim 9, wherein:

said horizontally movable holding elements are movable by adjustment units.

12. The apparatus of claim 9, further comprising:

a holding device below said removal ramp for gripping said printing plate released by said clamping device and conveying said plate released by said clamping device to a removal position.

13. The apparatus of claim 6, further comprising:

a holding bracket at a lower end of said removal ramp.

14. A method of feeding and removing printing plates from a rotary printing press comprising the steps of:

removing an old printing plate from a plate cylinder of said rotary printing press;

receiving said old printing plate on a receiving element adjacent said plate cylinder;

feeding a new printing plate on a feeding element adjacent said plate cylinder;

grasping a front edge of said new printing plate; and moving said front edge of said new printing plate such that said front edge is brought into contact with said plate cylinder.

15. The method of claim 14, wherein:

said step of moving said front edge comprises pivoting said front edge and deforming said front edge elastically.

16. The method of claim 14, wherein:

said step of grasping said front edge comprises applying a vacuum to said new printing plate.

17. The method of claim 14, wherein:

said step of feeding a new printing plate comprises contacting said front edge with horizontally movable holding elements; and wherein said step of moving said front edge comprises moving said horizontally movable holding elements out of contact with said front edge.

18. The method of claim 14, wherein:

said step of removing an old printing plate comprises gripping said old printing plate with a holding device and conveying said old printing plate to said receiving element.

19. An apparatus for replacing printing plates in a rotary printing press, said rotary printing press comprising a plate cylinder with a gap for receiving both ends of a printing plate while the surface of the printing plate is wound around said plate cylinder, said gap comprising a clamping device, said apparatus comprising:

an element for receiving a printing plate from said plate cylinder, after said printing plate has been released by said clamping device;

an element for feeding a new printing plate to said plate cylinder; and a pivotable holding device which temporarily holds a region of said new printing plate and pivots to deform said new printing plate elastically such that a front edge of said new printing plate is brought into contact with said plate cylinder, wherein said holding device is disposed on a support which is pivotable around a pivot axis and said support is arranged above said element for feeding a new printing plate.

20. A method of feeding and removing printing plates from a rotary printing press comprising the steps of:

removing an old printing plate from a plate cylinder of said rotary printing press;

receiving said old printing plate on a receiving element adjacent said plate cylinder, wherein said step of removing an old printing plate comprises gripping said old printing plate with a holding device and conveying said old printing plate to said receiving element, said step of gripping said old printing plate with a holding device comprises applying a vacuum to said old printing plate;

feeding a new printing plate on a feeding element adjacent said plate cylinder;

grasping a front edge of said new printing plate; and moving said front edge of said new printing plate such that said front edge is brought into contact with said plate cylinder.

* * * * *